US005303775A

United States Patent [19]

Michaels et al.

[11] Patent Number: 5,303,775

[45] Date of Patent: Apr. 19, 1994

[54] METHOD AND APPARATUS FOR ACQUIRING AND PROCESSING SUBSURFACE SAMPLES OF CONNATE FLUID

[75] Inventors: John M. Michaels; John T. Leder, both of Houston, Tex.

[73] Assignee: Western Atlas International, Inc., Houston, Tex.

[21] Appl. No.: 976,488

[22] Filed: Nov. 16, 1992

[51] Int. Cl.[5] ..... E21B 49/00

[52] U.S. Cl. ..... 166/264

[58] Field of Search ..... 166/264; 175/58, 59, 175/20, 40; 73/155, 863, 864.62

[56] References Cited

U.S. PATENT DOCUMENTS

| | | | |
|---|---|---|---|
| 4,583,595 | 4/1986 | Crernichow et al. | 166/264 |
| 4,597,439 | 7/1986 | Meek | 166/264 X |
| 4,766,955 | 8/1988 | Determann | 166/264 X |
| 5,195,588 | 3/1993 | Dave | 166/264 X |

*Primary Examiner*—Thui M. Bui
*Attorney, Agent, or Firm*—Darryl M. Springs

[57] ABSTRACT

A method and apparatus is provided for use in connection with a downhole formation testing instrument for acquisition of a phase intact sample of connate fluid for delivery via a pressure containing sample tank to a laboratory facility. One or more fluid sample tanks contained within the instrument are pressure balanced with respect to the wellbore at formation level and are filled with a connate fluid sample in such manner that during filling of the sample tanks the pressure of the connate fluid is maintained within the predetermined range above the bubble point of the fluid sample. The sample tank incorporates an internal free-floating piston which separates the sample tank into sample containing and pressure balancing chambers with the pressure balancing chamber being in communication with borehole pressure. The sample tank is provided with a cut-off valve enabling the pressure of the fluid sample to be maintained after the formation testing instrument has been retrieved from the wellbore for transportation to a laboratory facility. To compensate for pressure decrease upon cooling of the sample tank and its contents, the piston pump mechanism of the instrument has the capability of increasing the pressure of the sample sufficiently above the bubble point of the sample that any pressure reduction that occurs upon cooling will not decrease the pressure of the fluid sample below its bubble point.

15 Claims, 4 Drawing Sheets

METHOD AND APPARATUS FOR ACQUIRING AND PROCESSING SUBSURFACE SAMPLES OF CONNATE FLUID

FIELD OF THE INVENTION

This invention relates generally to a method and apparatus for subsurface formation testing, and more particularly concerns a method and apparatus for taking samples of connate fluid at formation pressure, retrieving the samples and transporting them to a laboratory for analysis while maintaining formation pressure. Even more specifically, the present invention concerns sample vessels that are utilized in conjunction with in situ multi-testing of subsurface earth formation wherein the sample vessels are removably assembled with multi-testing instruments and are separable from such instruments for transportation separately to a suitable site for laboratory analysis or for on-site analysis.

BACKGROUND OF THE INVENTION

The sampling of fluids contained in subsurface earth formations provides a method of testing formation zones of possible interest by recovering a sample of any formation fluids present for later analysis in a laboratory environment while causing a minimum of damage to the tested formations. The formation sample is essentially a point test of the possible productivity of subsurface earth formations. Additionally, a continuous record of the control and sequence of events during the test is made at the surface. From this record, valuable formation pressure and permeability data as well as data determinative of fluid compressibility, density and relative viscosity can be obtained for formation reservoir analysis.

Early formation fluid sampling instruments such as the one described in U.S. Pat. No. 2,674,313 were not fully successful as a commercial service because they were limited to a single test on each trip into the borehole. Later instruments were suitable for multiple testing; however, the success of these testers depended to some extent on the characteristics of the particular formations to be tested. For example, where earth formations were unconsolidated, a different sampling apparatus was required than in the case of consolidated formations.

Down-hole multi-tester instruments have been developed with extensible sampling probes for engaging the borehole wall at the formation of interest for withdrawing fluid samples therefrom and measuring pressure. In downhole instruments of this nature it is typical to provide an internal draw-down piston which is reciprocated hydraulically or electrically to increase the internal volume of a fluid receiving chamber within the instrument after engaging the borehole wall. This action reduces the pressure at the instrument formation interface causing fluid to flow from the formation into the fluid receiving chamber of the tool. Heretofore, the pistons accomplish suction activity only while moving in one direction. On the return stroke the piston simply discharges the formation fluid sample through the same opening through which it was drawn and thus provides no pumping activity. Additionally, unidirectional piston pumping systems of this nature are capable of moving the fluid being pumped in only one direction and thus causes the sampling system to be relatively slow in operation.

Early down-hole multi-tester instruments were not provided with a capacity for substantially continuous pumping of formation fluid. Even large capacity tools have heretofore been limited to a maximum draw-down collection capability of only about 1000 cc and they have not heretofore had the capability of selectively pumping various fluids to and from the formation, to and from the borehole, from the borehole to the formation, or from the formation to the borehole. U.S. Pat. No. 4,513,612 describes a Multiple Flow Rate Formation Testing Device and Method which allows the relatively small volume draw-down volume to be discharged into the wellbore or to be forced back into the formation. The use of "passive" valves as taught in this method precludes reverse flow. This method does provide for limited or one shot reverse flow much like a hypodermic needle but transferring large volumes of fluid between two reservoirs in a near continuous manner is not achievable with this method. It is desirable, therefore, to provide a down-hole fluid sampling tool with enhanced pumping capability with an unlimited capacity for discharge of formation fluid into the wellbore and with the capability to achieve bi-directional fluid pumping to enable a reverse flow activity that permits fluid to be transferred to or from a formation. It is also desirable to provide a down-hole testing instrument having the capability of selectively pumping differing fluids such as formation fluid, known oils, known water, known mixtures of oil and water, known gas-liquid mixtures, and/or completion fluid to thereby permit in situ determination of formation permeability, relative permeability and relative viscosity and to verify the effect of a selected formation treatment fluid on the producibility of connate fluid present in the formation.

In all cases known heretofore, down-hole multi-test sampling apparatus incorporates a fluid circuit for the sampling system which requires the connate fluid extracted from the formation, together with any foreign matter such as fine sand, rocks, mud-cake, etc. encountered by the sampling probe, to be drawn into a relatively small volume chamber and which is discharged into the borehole when the tool is closed as in U.S. Pat. No. 4,416,152. Before closing, a sample can be allowed to flow into a sample tank through as separate but parallel circuit. Other methods provide for the sample to be collected through the same fluid circuit.

U.S. Pat. No. 3,813,936 describes a "valve member 55" in column 11, lines 10–25 which forces trapped wellbore fluids in a "reverse flow" through a screen member as the "valve member 55" is retracted. This limited volume reverse flow is intended to clean the screen member and is not comparable to bi-directional flow described in this disclosure because of the limited volume.

Mud filtrate is forced into the formation during the drilling process. This filtrate must be flushed out of the formation before a true, uncontaminated sample of the connate fluid can be collected. Prior art sampling devices have a first sample tank to collect filtrate and a second to collect connate fluid. The problem with this procedure is that the volume of filtrate to be removed is not known. For this reason it is desirable to pump formation fluid that is contaminated with filtrate from the formation until uncontaminated connate fluid can be identified and produced. Conventional down-hole testing instruments do not have an unlimited fluid pumping capability and therefore cannot ensure complete flushing of the filtrate contaminant prior to sampling.

Estimates of formation permeability are routinely made from the pressure change produced with one or more draw-down piston. These analyses require that the viscosity of the fluid flowing during pumping be known. This is best achieved by injecting a fluid of known viscosity from the tool into the formation and comparing its viscosity with recovered formation fluid. The permeability determined in this manner can then be reliably compared to the formations in off-site wells to optimize recovery of fluid.

A reversible pump direction will also allow a known fluid to be injected from the tool or borehole into the formation. For example, treatment fluid stored within an internal tank or compartment of the instrument or drawn from the wellbore may be injected into the formation. After injection, additional draw-downs and/or sampling may take place to determine the effect of the treatment or completion fluid on the producibility of the formation. Early formation sampling instruments have not been provided with features to determine the optimum sampling pressures. The present invention also provides a positive method for overcoming differential sticking of the packer by pumping fluid into the formation at a high pressure thereby unseating the packer.

The present invention overcomes the deficiencies of the prior art by providing method and apparatus for achieving in situ pressure, volume and temperature (PVT) measurement through utilization of a double-acting, bi-directional fluid control system incorporating a double-acting bi-directional piston pump capable of achieving pumping activity at each direction of its stroke and capable through valve stroke to achieve bi-directional fluid flow and having the capability of selectively discharging acquired connate fluid into the wellbore or into sample containing vessels or pumping fluid from the wellbore or a sample containing vessel into the formation. The connate fluid samples are acquired in such manner that the sample does not undergo phase separation at any point in the sample acquisition process.

SUMMARY OF THE INVENTION

It is a principle feature of the present invention to provide a novel method for acquisition of connate fluid sample from a subsurface earth formation, for retrieving the sample to the surface and providing a safe pressure vessel for transporting it to a suitable laboratory for analysis, while maintaining formation pressure.

It is also a feature of this invention to provide a novel method and apparatus for acquisition of a fluid sample from a subsurface earth formation, controlling the sampling pressure as desired, and then retrieving the connate fluid sample and conducting it to a suitable laboratory for analysis while maintaining the modified pressure of the sample.

It is an even further feature of this invention to provide a novel method and apparatus for acquiring and retrieving connate samples from subsurface earth formations wherein apparatus for acquisition of the sample constitutes a component part of a down-hole multi-tester instrument incorporating a removable sample vessel or tank within which the sample fluid may be retrieved and transported to a laboratory site for analysis while maintaining the fluid sample under predetermined pressure exceeding the bubble point pressure of the fluid sample.

It is another feature of this invention to provide a novel method and apparatus for acquiring a sample of connate fluid from a subsurface formation, at formation temperature and overpressuring the fluid sample within a sample retrieving vessel so that the connate sample will maintain a pressure above the sample's bubble point in order to avoid phase separation after the sample vessel and sample have cooled to surface temperature.

Briefly, the various features of the present invention are effectively realized through the provision of a down-hole formation testing instrument which, in addition to having the capability of conducting a variety of predetermined down-hole tests of the formation and formation fluid, is adapted to retrieve and contain at least one sample of the connate fluid which will be transported to the surface along with the formation testing instrument. Thereafter, the sample, being contained under formation pressure or a pressure exceeding formation pressure is separated from the testing instrument and is conducted to a suitable laboratory for laboratory analysis.

To accomplish these features, the formation testing instrument incorporates a sample taking section defining at least one and preferably a plurality of sample container receptacles. Each of these receptacles releasably contain a sample vessel or tank which is coupled to respective fluid conducting passages of the instrument body. The sample is withdrawn from the formation by the sampling probe of the instrument and is then transferred into the sample vessel by hydraulically energized bi-directional positive displacement piston pump that is incorporated within the instrument body. In order to facilitate filling of the sample tank with connate fluid without reducing the pressure of the fluid at any point in the sample gathering procedure below the bubble point of the connate fluid. The sample tank is pressure balanced with respect to borehole pressure at formation level prior to its filing. Thus the connate fluid contains its original phase characteristics as the sample tank is filled. After filling of the sample tank, in order to compensate for cooling of the sample tank and its contents after it has been withdrawn from the wellbore to the surface and perhaps conducted to a remote laboratory facility for investigation, the piston pump has the capability of overpressuring the fluid sample to a level well above the bubble point of the sample. The hydraulically energized piston pump that accomplishes filling of the sample tank with the sample fluid is controlled to to increase the pressure of the connate fluid within the sample tank such that upon cooling of the sample tank and its contents, the connate fluid sample will be maintained at a pressure exceeding formation pressure. This feature compensates for temperature changes and prevents phase separation of the connate fluid as a result of cooling of the sample tank and its contents.

After the sample tank has been withdrawn from the wellbore, along with the formation testing instrument, the pressure within the fluid supply passage from the instrument pump to the sample tank is maintained at the preestablished pressure level until a manually operable tank valve is closed. Thereafter the pump supply line is vented to relieve pressure upstream of the closed sample tank valve. After this has been accomplished, the sample tank and its contents is removed from the instrument body simply by unthreading a few hold-down bolts. The sample tank is thus free to be withdrawn from the instrument body and provided with protective end closures, thus rendering it to a condition that is suitable for shipping to an appropriate laboratory facility.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

IN THE DRAWINGS

Figure 1:
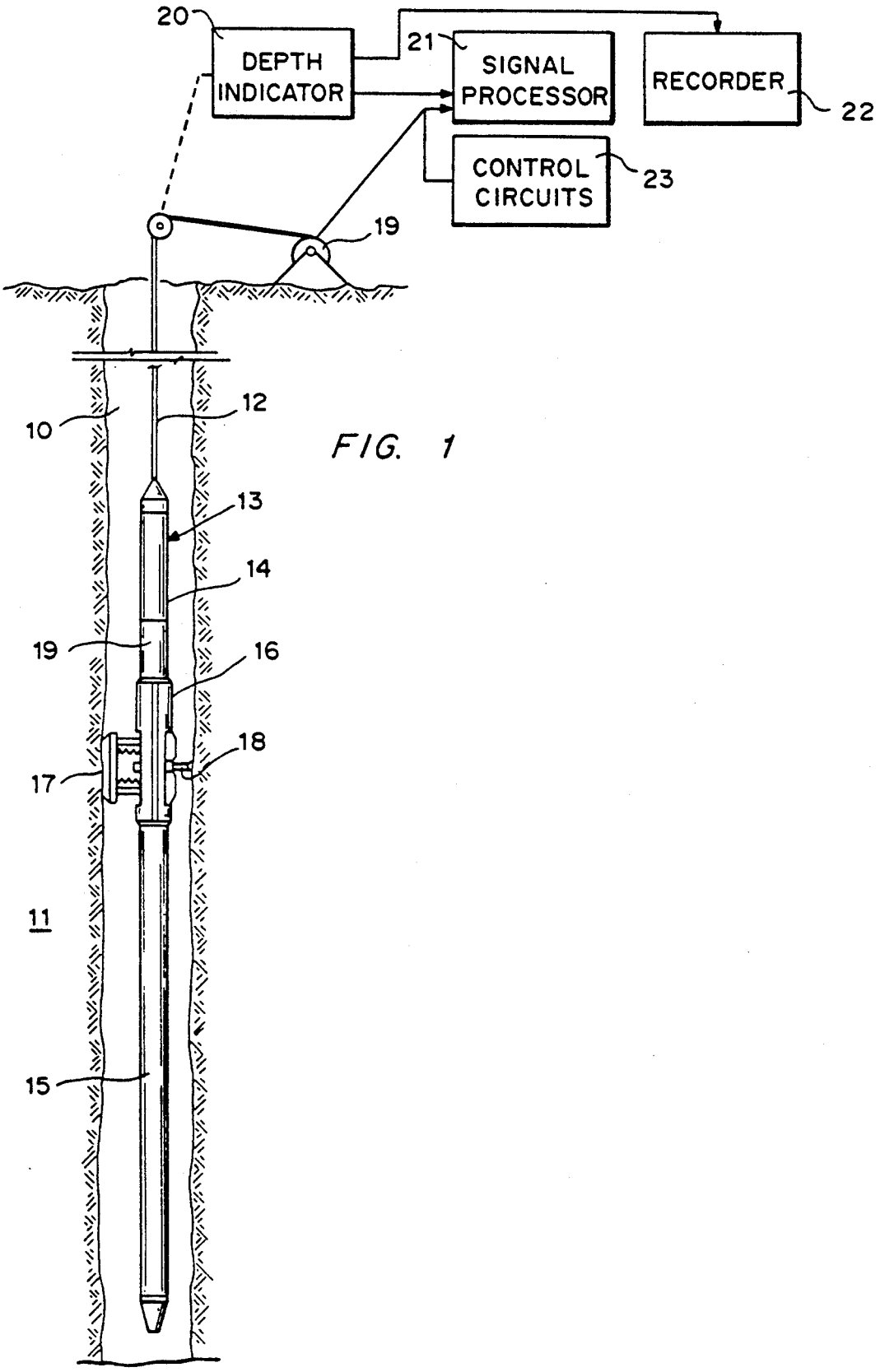

FIG. 1 is a pictorial illustration including a block diagram schematic which illustrates a formation testing instrument constructed in accordance with the present invention being positioned at formation level within a wellbore, with its sample probe being in communication with the formation for the purpose of conducting tests and acquiring one or more connate samples.

Figure 2:
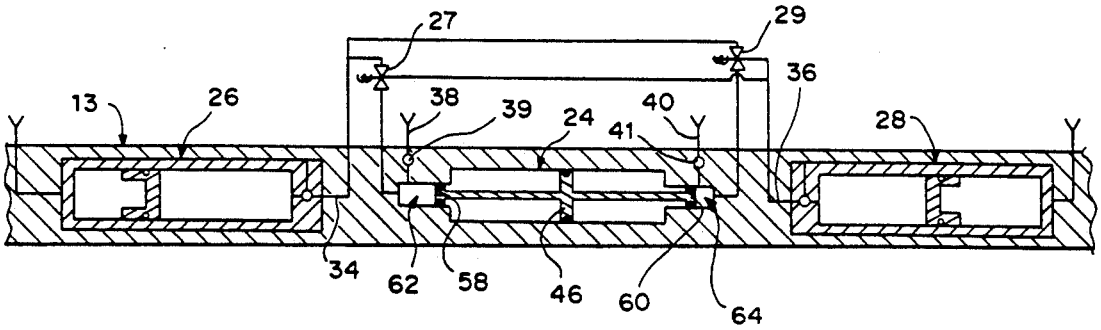

FIG. 2 is a schematic illustration of a portion of downhole formation multi-tester instrument which is constructed in accordance with the present invention and which illustrates schematically a piston pump and a pair of sample tanks within the instrument.

Figure 3:
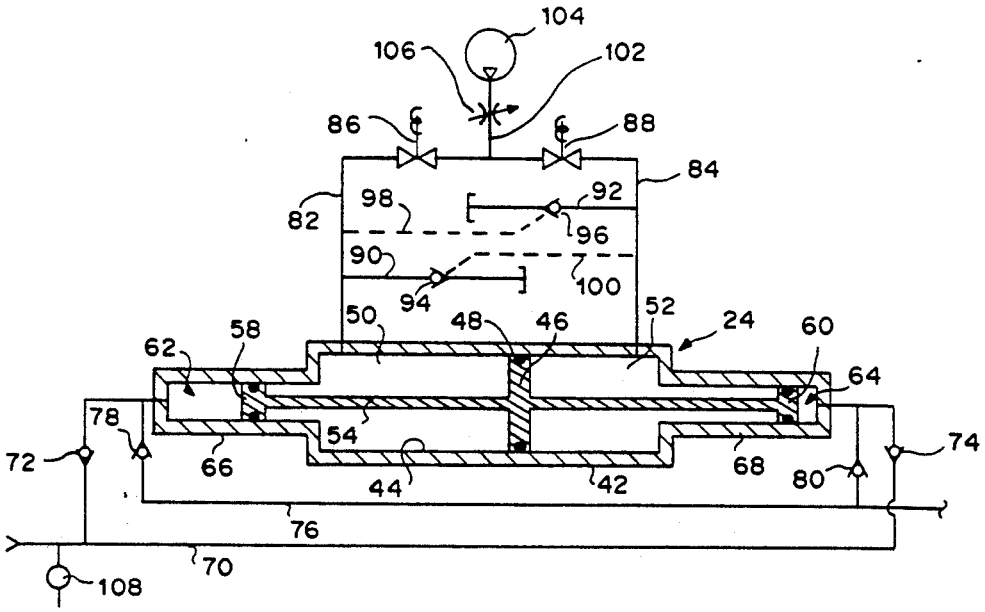

FIG. 3 is a schematic illustration of a bi-directional hydraulically energized positive displacement piston pump mechanism and the pump pressure control system thereof.

Figure 4:
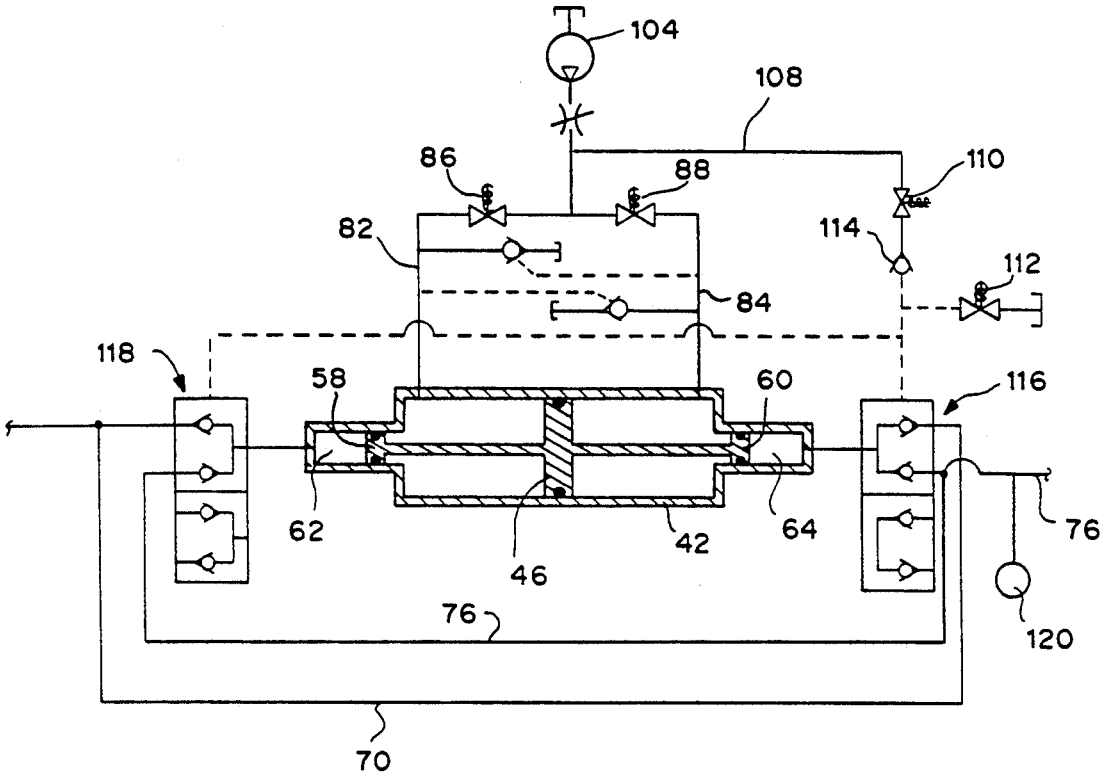

FIG. 4 is a schematic illustration of a bi-directional piston pump and check valve circuit that represents an alternative embodiment of this invention.

Figure 5:
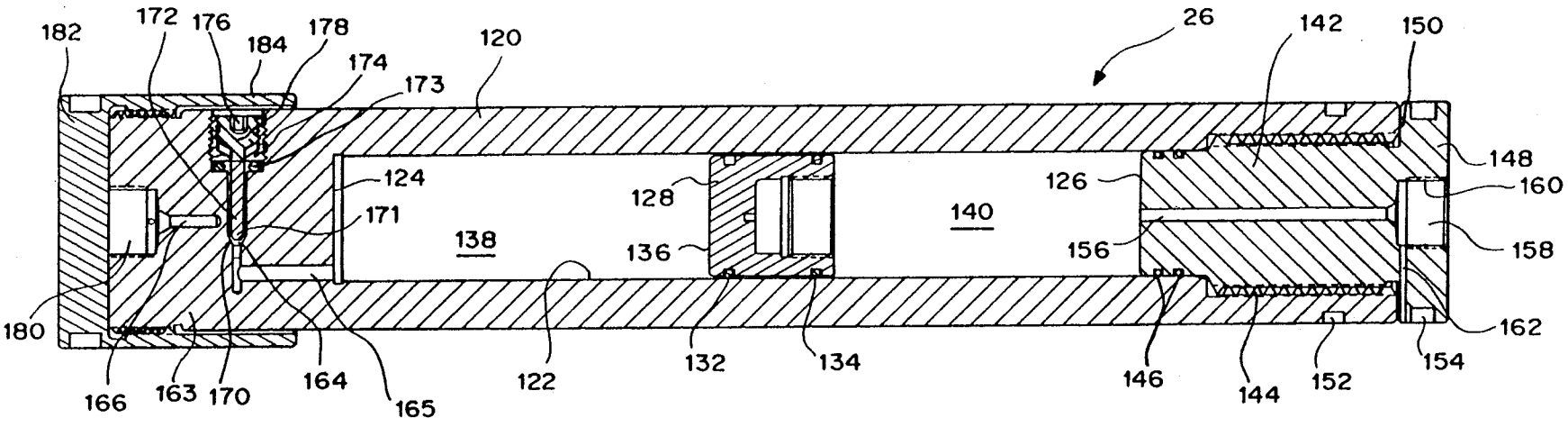

FIG. 5 is a sectional view of a pressurized sample tank assembly that is constructed in accordance with the present invention.

DETAILED DESCRIPTION OF PREFERRED EMBODIMENT

Referring now to the drawings in more detail, particularly to FIG. 1, there is illustrated schematically a section of a borehole 10 penetrating a portion of the earth formations 11, shown in vertical section. Disposed within the borehole 10 by means of a cable or wireline 12 is a sampling and measuring instrument 13. The sampling and measuring instrument is comprised of a hydraulic power system 14, a fluid sample storage section 15 and a sampling mechanism section 16. Sampling mechanism section 16 includes selectively extensible well engaging pad member 17, a selectively extensible fluid admitting sampling probe member 18 and bi-directional pumping member 19. The pumping member 19 could also be located above the sampling probe member 18 if desired.

In operation, sampling and measuring instrument 13 is positioned within borehole 10 by winding or unwinding cable 12 from hoist 20, around which cable 12 is spooled. Depth information from depth indicator 21 is coupled to signal processor 22 and recorder 23 when instrument 13 is disposed adjacent an earth formation of interest. Electrical control signals from control circuits 24 are transmitted through electrical conductors contained within cable 12 to instrument 13.

These electrical control signals activate an operational hydraulic pump within the hydraulic power system 14 shown schematically in FIG. 7, which provides hydraulic power for instrument operation and which provides hydraulic power causing the well engaging pad member 17 and the fluid admitting member 18 to move laterally from instrument 13 into engagement with the earth formation 11 and the bi-directional pumping member 19. Fluid admitting member or sampling probe 18 can then be placed in fluid communication with the earth formation 11 by means of electrical controlled signals from control circuits 24 selectively activating solenoid valves within instrument 13 for the taking of a sample of any producible connate fluids contained in the earth formation of intent.

As illustrated in the partial sectional and schematic view of FIG. 2, the formation testing instrument 13 of FIG. 1 is shown to incorporate therein a bi-directional piston pump mechanism shown generally at 24 which is illustrated schematically, but in greater detail, in FIG. 3. Within the instrument body 13 is also provided at least one and preferably a pair of sample tanks which are shown generally at 26 and 28 and which may be of identical construction if desired. The piston pump mechanism 24 defines a pair of opposed pumping chambers 62 and 64 which are disposed in fluid communication with the respective sample tanks via supply conduits 34 and 36. Discharge from the respective pump chambers to the supply conduit of a selected sample tank 26 or 28 is controlled by electrically energized three-way valves 27 and 29 or by any other suitable control valve arrangement enabling selective filling of the sample tanks. The respective pumping chambers are also shown to have the capability of fluid communication with the subsurface formation of interest via pump chamber supply passages 38 and 40 which are defined by the sample probe 18 of FIG. 1 and which are controlled by appropriate valving as shown in FIG. 3, to be discussed hereinbelow. The supply passages 38 and 40 may be provided with check valves 39 and 41 to permit overpressure of the fluid being pumped from the chambers 62 and 64 if desired.

As mentioned above, it is one of the important features of the present invention to provide for acquisition of connate fluid in such manner that the sample does not undergo phase separation during its acquisition and handling to the point of laboratory analysis. This feature is accomplished by controlling the pressure of connate fluid drawdown from the formation by the bi-directional pump 24 and controlling introduction of the connate fluid into the sample tank 26 or 28 so that its pressure at any point in time does not fall below the bubble point pressure of the connate fluid sample. This feature is at least in part accomplished by controlling hydraulically energized operation of the bi-directional drawdown pump 24 in accordance with pressure conditions within the well bore at formation level. Referring now to FIG. 3 the bi-directional piston pump mechanism 24 incorporates a pump housing 42 forming an internal cylindrical surface or cylinder 44 within which is movably positioned a piston 46 which maintains sealed relation with the internal cylindrical surface 44 by means of one or more piston seals 48. The piston 46 separates the internal chamber of the cylinder into piston chambers 50 and 52. From the piston 46 extends a pair of opposed pump shafts 54 and 56 having pump pistons 58 and 60 at respective extremities thereof which are movably received within pump chambers 62 and 64 which are defined by opposed reduced diameter pump cylinders 66 and 68 which are defined by opposed extensions of the pump housing 42. As the pump motor piston 46 is moved in one direction by virtue of hydraulic energization, the pump piston in its direction of movement achieves a pumping stroke while the opposite pump piston achieves a suction stroke to draw fluid into its pump chamber.

The pump chambers are disposed in selective communication with a sample supply line 70 from which connate fluid is transferred from the formation into the pump chambers 62 or 64 as determined by the direction of pump piston movement. The fluid supply line 70 is in communication with the packer or sample probe of the formation testing instrument. The flow of fluid in line 70 is unidirectional, being controlled by check valves 72 and 74. The pump chambers 62 and 64 are also in communication with a pump discharge line 76 which is in communication with one of the sample tanks for filling thereof or in communication with the borehole as determined by appropriate valving, not shown. The fluid flow in line 76 is also unidirectional, being controlled by check valves 78 and 80 respectively.

For operation of the drawdown piston assembly in a manner that prevents phase separation of the connate fluid during drawdown and pumping, a pump motor control feature is provided, whereby the intake and discharge pressures of the bi-directional pump are controlled within a narrow pressure range which is predetermined to prevent phase separation of the connate fluid. The pressure in supply line 70 can be monitored with a pressure gage 108 to provide information for controlling pump actuating movement of the pump motor piston 46. For this purpose, the drawdown piston assembly provides for control of the pressure difference between the present sample line fluid pressure and the minimum sample pressure during drawdown. Control of this differential pressure is accomplished via a pressure regulator to control the flow of hydraulic oil moving the pump motor piston 46. For this purpose hydraulic oil supply lines 82 and 84, which communicate respectively with the piston chambers 50 and 52, are provided with solenoid energized control valves 86 and 88 respectively. These supply lines are also provided with discharge or return lines 90 and 92 which include normally closed pilot valves 94 and 96 respectively, which are propped open responsive to pressure communicated thereto by pilot pressure supply lines 98 and 100. Thus, upon pressurization of supply line 82, its pressure is communicated by a pilot line 98 to the pilot valve 96, opening the pilot valve and permitting hydraulic oil in the piston chamber 52 to vent to the sump or reservoir, with the pump motor piston 46 moving toward the pump cylinder 68. The reverse is true with the piston 46 moving in the opposite direction such as by opening of solenoid energized control valve 88.

Hydraulic oil is communicated to the supply lines 82 and 84 by a hydraulic supply line 102 disposed in communication with a source 104 of pressurized hydraulic fluid having its pressure controlled by a pressure regulator 106.

Referring now to FIG. 4, there is shown a simplified schematic illustration of a portion of the downhole instrument to perform pressure-volume-temperature (PVT) measurement down-hole with the wireline formation tester while seated against the formation. In cases where differential sticking is a problem, the sample could be taken into a tank after which the tool can be closed and moved slowly up or down the borehole while PVT analysis is conducted on the fluid in the sampling tank. One of its purposes is to determine the bubble point of fluid/gas samples collected from the formation of interest.

Before or after a sufficient amount of formation fluid is purged from the formation into either a tank or to the borehole, the formation testing instrument performs a measurement of pressure, temperature and volume of a finite sample of formation fluid. This is accomplished by the use of the double-acting bi-directional pump mechanism which includes a pump-through capability. The simplified illustration of FIG. 4 discloses a hydraulic operating pressure supply pump 104, representing the hydraulic fluid supply which discharges pressurized hydraulic fluid through a pilot pressure supply conduit 108 under the control of a pair of solenoid valves 110 and 112 together with a check valve 114. These normally closed solenoid valves are selectively operated to direct the flow of hydraulic fluid from the hydraulic pump 104 to a normally open, two-way dirty fluid valve, shown generally at 116 and 118. The dirty fluid check valve assembly, shown in 116 contains two separate check valves which can be interposed between line 70 and 76 and chamber 64, the flow of fluid into chamber 66 is determined by which set of check valves is interposed in the position shown in FIG. 4. When piston 60 is moving to the left, fluid enters chamber 64 from line 70 and when piston 60 is moving to the right fluid is discharged from chamber 64 into line 76. When solenoid valve 110 is actuated to interpose the lower two dirty fluid check valves of check valve assembly 116 between chamber 64 and lines 70 and 76, the fluid flow enters chamber 64 from line 76 when piston 60 moves to the left and fluid is discharged from chamber 64 into line 70 when piston 60 moves to the right. Like pumping action occurs with piston 58, pump chamber 62 and dirty fluid check valve assembly 118. The selective flow of fluid to a sample collection tank or the borehole is thus controlled by positioning the dirty fluid check valve assemblies 116 and 118 in coordination.

As mentioned above in connection with FIG. 2, it is desirable to accomplish filling of the sample tank 26 without causing or allowing the pressure of the fluid sample to decrease below the bubble point of the connate fluid. This is achieved by pumping fluid by means of the bi-directional piston pump 24 into a sample tank that is pressure balanced with respect to the fluid pressure of the borehole at formation level. The sample tank illustrated schematically in FIG. 2 and in detail in FIG. 5 accomplishes this feature. As shown, the sample tank 26 incorporates a tank body structure 120 which forms an inner cylinder defined by an internal cylindrical wall surface 122 and opposed end walls 124 and 126. A free floating piston member 128 is movably positioned within the cylinder and incorporates one or more seal assemblies as shown at 132 and 134 which provide the piston with high pressure containing capability and establish positive sealing engagement between the piston and the internal cylindrical sealing surface 122. The seals 132 and 134 are typically high pressure seals and thus provide the sample tank with the capability of retaining a connate fluid sample at the typical formation pressure that is present even in very deep wells. The piston 128 is a free floating piston which is typically initially positioned such that its end wall 136 is positioned in abutment with the end wall 124 of the cylinder. The piston functions to partition the cylinder into a sample containing chamber 138 and a pressure balancing chamber 140. When the sample tank is full, the piston will be seated against a support shoulder 126 of a closure plug 142. In this supported position the piston will function as an internal tank closure and will prevent leakage of fluid pressure from one end of the sample tank.

While the end wall 124 of the cylinder is typically integral with the sample tank structure, the end wall 126 is defined by an externally threaded plug 142 which is received by an internally threaded enlarged diameter section 144 of the sample tank housing 120. The closure plug 144 includes one or more seals such as shown at 146 which establish positive sealing between the closure plug and the internal cylindrical surface 122 of the tank housing. The closure plug forms an end flange 148 which is adapted to seat against an end shoulder 150 of the sample tank housing when the plug is in fully threaded engagement within the housing. The housing and plug flange define a plurality of external receptacles 152 and 154 which are engaged by means of a spanner wrench or by any other suitable implement that enables the closure plug 142 to be tightly threaded into the sample tank body or unthreaded and withdrawn from the sample tank body as the case arises.

The sample tank plug 142 defines a pressure balancing passage 156 which may be closed by a small closure plug 158 which is received by an internally threaded receptacle 160 that is located centrally of the end flange 148. While positioned downhole, the closure plug 158 will not be present, thereby permitting entry of formation pressure into the pressure balancing chamber 140. To insure that there is no pressure build-up within the chamber 140 as the closure plug 158 is threaded into its receptacle, a vent passage 162 is defined in the end flange of the closure plug 142 which serves to vent any air or liquid which may be present within the closure plug receptacle.

The end wall structure 163 of the tank housing 120 defines a valve chamber 164 to which is communicated a sample inlet passage 166. a tapered internal valve seat 170 defined at one end of the valve chamber 164 is disposed for sealing engagement by a correspondingly tapered valve extremity 171 of a valve element 172. The valve element 172 is sealed with respect to the tank body 120 by means of an annular sealing element 173 which is secured within a seal chamber above the valve element by means of a threaded seal retainer 174. In order to permit introduction of a connate fluid sample into the sample chamber 138, the valve element 172 must be in its open position such that the tapered valve extremity 171 is disposed in spaced relation with the tapered valve seat 170, thereby allowing fluid entry into chamber 138 via the inlet passage way 165. As the connate fluid sample is introduced into the sample chamber 138, a slight pressure differential will develop across the piston 128 and, because it is free-floating within the cylinder, the piston will move toward the end surface 126 of the closure plug 142. When the piston has moved into contact with the end surface 126 of the closure plug, the sample chamber 138 will have been completely filled with connate fluid. The high pressure seals of the piston allow the sample to be overpressured to maintain a pressure level within the sample tank above the bubble point pressure of the sample upon cooling of the sample tank and its contents. Thus, the high pressure containing capability of the piston seals, even under a condition of overpressure, will prevent leakage of the sample fluid from the sample chamber to the pressure balancing passage. The piston thus also serves as an end seal for the sample tank.

The downhole multi-tester instrument will maintain the preestablished pressure of the sample chamber while the instrument is retrieved from the well bore. Prior to release of this predetermined pressure upstream of the sample chamber, the valve element 174 will be moved to its closed and sealed position bringing the tapered end surface 172 thereof into positive sealing engagement with the tapered valve seat surface 170. Closure of the valve element 174 is accomplished by introducing a suitable tool, such as an allen wrench for example, into a drive depression 176 of an externally accessible valve operator element 178. After the valve element 174 has been closed, the pressure of the sample chamber 138 will be maintained even though the inlet passage 166 upstream of the valve is vented. The sample tank 126 may be separated from the instrument for transport to a suitable laboratory facility after the upstream portion of the sample inlet passage 166 has been vented. The passage 166 is then isolated from the external environment by means of a closure plug 180 which may be substantially identical to the closure plug 158. Thereafter, an end cap 182 is threaded onto the end of the sample tank to insure protection of the end portion thereof during transportation. The end cap 182 incorporates a valve protector sleeve 184 which extends along the outer surface of the tank body a sufficient distance to cover and provide protection for the valve actuator 178. The cover sleeve portion of the end cap 182 insures that the valve actuator 178 remains inaccessible so that the valve can not be accidentally opened. This feature prevents the potentially high pressure of connate fluid within the sample chamber 138 from being accidentally vented during handling.

In view of the foregoing, it is evident that the present invention is one well adapted to attain all of the objects and features hereinabove set forth, together with other objects and features which are inherent in the apparatus disclosed herein.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. A method of acquiring a phase intact connate fluid sample from a subsurface earth formation for subsequent analysis, by means of a formation testing instrument that incorporates a pressure containing sample tank having an internal fluid chamber, comprising:

(a) positioning said formation testing instrument within a wellbore and in fluid transferring communication with the formation;

(b) establishing a balanced pressure condition between said internal fluid chamber of said sample tank and the fluid in the wellbore at formation depth;

(c) transferring connate fluid from said formation into said sample tank while controlling the pressure of said connate fluid within a predetermined range appropriate to prevent phase separation thereof;

(d) removing said formation testing instrument from the wellbore; and (e) analyzing said phase intact connate fluid sample contained within said fluid chamber of said sample tank.

2. The method of claim 1, wherein said sample tank is disposed in removable assembly with said formation testing instrument, said method including:

after said removal of said formation testing instrument from said wellbore, separating said sample tank from said formation testing instrument and transporting said sample tank to a laboratory facility for said analyzing of said phase intact connate fluid sample.

3. The method of claim 1, wherein said sample tank is disposed in removable assembly with said formation testing instrument, said method including:

after said removal of said formation testing instrument from said wellbore, separating said sample tank from said formation testing instrument and analyzing said phase intact connate fluid sample thereof.

4. The method of claim 1, including:

while said formation testing instrument is at formation level within said well bore, increasing the pressure of said connate fluid within said sample tank to a sufficient pressure level to compensate for pressure decrease as the result of cooling of said sample tank from formation temperature to ambient temperature.

5. The method of claim 1, wherein said sample tank is in removable assembly with said formation testing instrument and incorporates a connate fluid inlet having an inlet shut-off valve and said formation testing instrument incorporates a connate fluid supply conduit in separable communication with said sample tank and having a fluid supply control valve, said method including:

(a) developing a predetermined connate fluid sample pressure within said connate fluid supply conduit and said sample tank;

(b) prior to said recovery of said formation testing instrument, closing said fluid supply control valve to maintain said predetermined pressure during said recovery;

(c) after said recovery of said formation testing instrument, closing said inlet shut-off valve of said sample tank;

(d) after closing of said inlet shut-off valve, bleeding connate fluid pressure upstream of said inlet shut-off valve; and (e) removing said sample tank from said formation testing instrument to a laboratory for said analyzing of said connate fluid sample.

6. The method of claim 1, wherein said transferring of said connate fluid comprises:

pumping said connate fluid from said formation into said sample tank in such manner that the pressure change of said connate fluid is maintained within a range that prevents phase separation thereof.

7. The method of claim 6, wherein said pumping is accomplished by a hydraulically energized piston pump having at least one positive displacement pumping chamber having a piston therein and being in communication with said formation and said sample tank via a fluid flow passage system having valving. Said method including:

reciprocating said piston and operating said valving to control piston induced unidirectional flow of said connate fluid from said formation into said pumping chamber and from said pumping chamber into said sample tank.

8. The method of claim 7, including:

controlling reciprocating pumping movement of said piston responsive to the difference between sample line fluid pressure and minimum sample pressure during drawdown.

9. The method of claim 8, wherein said controlling comprises:

regulating the pressure of hydraulic fluid being introduced into said piston pump for controlling the velocity of movement of said piston.

10. A formation testing and sampling instrument for acquisition of a phase intact sample of connate fluid from a subsurface formation of interest being intersected by a wellbore, comprising:

(a) said instrument having means for establishing fluid communication with said subsurface formation and having an internal fluid sample circuit;

(b) a sample tank being within said instrument and in communication with said fluid sample circuit;

(c) a positive displacement piston type drawdown pump being disposed within said instrument and having a pumping chamber in controlled communication with said fluid sample circuit, said drawdown pump being operative for drawing of said connate fluid from said subsurface formation and pumping said connate fluid into said sample tank;

(d) means for controlling said drawing and pumping of said connate fluid within a predetermined pressure range that is sufficient to prevent phase separation of said connate fluid; and (e) means for maintaining the pressure of said connate fluid within said sample tank within said predetermined pressure range during withdrawal of said instrument from said well bore and until laboratory analysis thereof is initiated.

11. The formation testing and sampling instrument of claim 10, including:

means for accomplishing pressure balancing of said sample tank with borehole pressure prior to acquisition of said connate fluid sample from said subsurface formation.

12. The formation testing and sampling instrument of claim 11, wherein said pressure balancing means comprises:

(a) a free piston within said sample tank defining a sample chamber and a pressure balancing chamber therein, said pressure balancing chamber being open to wellbore pressure;

(b) a connate fluid sample inlet passage being defined by sample tank and being adapted for communication with the connate fluid discharge of said drawdown pump; and (c) means within said sample tank for sealing said sample inlet after filling of said sample chamber of said sample tank.

13. The formation testing and sampling instrument of claim 12, wherein said means within said sample tank for sealing said sample fluid inlet comprises:

a high pressure containing valve being disposed within said sample tank and being movable to an open position for admitting the fluid sample into said sample chamber and to a closed position for blocking said sample inlet.

14. The formation testing and sampling instrument of claim 13, wherein:

said high pressure containing tank valve is a manually operable valve which is closed while sample pressure is being maintained by said formation testing and sampling instrument.

15. The formation testing and sampling instrument of claim 14, wherein:

said formation testing and sampling instrument includes a sample inlet vent control permitting selective venting of said sample inlet upstream of said high pressure containing tank valve after closure thereof to permit separation of said sample tank from said formation testing and sampling instrument for transportation to a laboratory facility.

* * * * *